United States Patent [19]

Barbano

[11] 4,434,425

[45] Feb. 28, 1984

[54] MULTIPLE RING DIPOLE ARRAY

[75] Inventor: Normand Barbano, Sunnyvale, Calif.

[73] Assignee: GTE Products Corporation, Stamford, Conn.

[21] Appl. No.: 345,269

[22] Filed: Feb. 2, 1982

[51] Int. Cl.[3] ..... H01Q 21/26

[52] U.S. Cl. ..... 343/797; 343/814

[58] Field of Search ..... 343/796–800, 343/813, 814, 853

[56] References Cited

U.S. PATENT DOCUMENTS 3,747,111 7/1973 Fletcher ..... 343/797

4,083,051 4/1978 McDonald ..... 343/797

*Primary Examiner*—Eli Lieberman

*Attorney, Agent, or Firm*—John F. Lawler

[57] ABSTRACT

A multiple ring dipole array comprises a plurality of dipole elements arranged in concentric rings and in a common plane. Each ring has a plurality of circumferentially spaced dipole elements, preferably folded dipoles, having equal lengths and disposed in opposed parallel pairs with elements of each pair spaced by one-half wavelength at center frequency. The elements of adjacent arrays have different lengths selected to provide contiguous or slightly overlapping operating frequency bands, the elements of one ring extending in directions transversely of the elements in the adjacent ring to minimize mutual coupling. Each element is fed by a pair of phase-matched coaxial lines connected to suitable switching circuitry by a hybrid junction. The array has a common phase center over the entire band and so has particular utility as a feed for a parabolic reflector.

8 Claims, 6 Drawing Figures

MULTIPLE RING DIPOLE ARRAY

BACKGROUND OF THE INVENTION

This invention was made under a contract with the Department of the Army.

This invention relates to dipole antennas and more particularly to a broadband dipole antenna array useful as a feed for a parabolic reflector.

An antenna system employing a parabolic dish reflector is widely used for tracking and direction finding applications which often require operation over a broadband of frequencies. The bandwidth of such a system is limited by the bandwidth of the reflector feed device which must have a phase center coincident with the focal point of the reflector. One such feed device used in the past has been an array of four identical dipoles disposed in one plane and symmetrically arranged about a center point which is the phase center of the array and which necessarily is coincident with the focal point of the reflector. The bandwidth of such a system is restricted to the bandwidth of this dipole array which accordingly limits system performance.

Another approach to solving of the problem of extending the bandwidth of such an antenna system is to mount an auxiliary feed having additional frequency coverage on a pivoted arm capable of moving such feed into and out of an operative position in front of the reflector. Primary disadvantages of this approach are that the movable feed blocks the existing feed device from illuminating the reflector, thus disabling the latter, the phase center of the auxiliary feed is not coincident with the focal point of the reflector, and the additional structure is bulky and cumbersome.

Another approach to solving the problem is placement of the auxiliary antenna to the side of the existing feed. This prevents the blockage mentioned above. Although this add-on antenna can be mounted with its phase center in the focal plane of the parabolic reflector, the phase center is displaced laterally from the focal line. This results in secondary patterns that are generated from the add-on feed to be scanned off the boresight axis of the reflector. Hence the radiation pattern main beams of the existing feed and of the add-on feed are not boresighted.

This invention is directed to a solution of the above problems.

OBJECTS AND SUMMARY OF THE INVENTION

A general object of the invention is the provision of a broadband antenna feed for a parabolic reflector.

A further object is the provision of an antenna array having a continuous operating frequency over a band limited only by the physical size of the array that can be tolerated.

Still another object of the invention is the provision of a selectably polarized antenna capable of being used as a self-contained feed for a parabolic antenna or as an independent moderate gain antenna.

These and other objects of the invention are achieved with an array comprising a plurality of concentric coplanar sets or rings of dipole elements, preferably folded dipoles, the elements of adjacent sets having a common phase center and different dimensions selected to provide such adjacent sets with contiguous or slightly overlapping bandwidths. The array has particular utility when used as a feed for a parabolic reflector, the common phase center of the dipole sets being coincident with the focal point of the reflector for efficient illumination of the latter.

DESCRIPTION OF PREFERRED EMBODIMENTS

Figure 1:
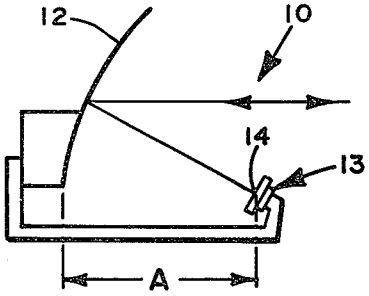
FIG. 1 is a schematic elevational view of an antenna array embodying this invention used as a feed for a parabolic reflector.

Referring now to the drawings, FIG. 1 illustrates an antenna system 10 embodying the invention comprising the upper portion 12 of a parabolic reflector illuminated or fed by a feed device 13 located at the focal point 14 of the reflector. In order to obtain optimum performance from this antenna system, the phase center of feed device 13 must be coincident with the focal point 14 of reflector 12 over the operating bandwidth of the system.

Figure 3:
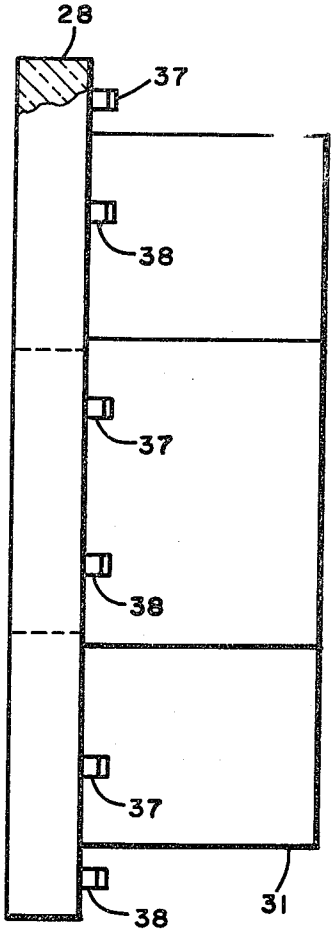
FIG. 3 is a side elevation of the antenna as viewed on line 3—3 of FIG. 2.
Figure 2:
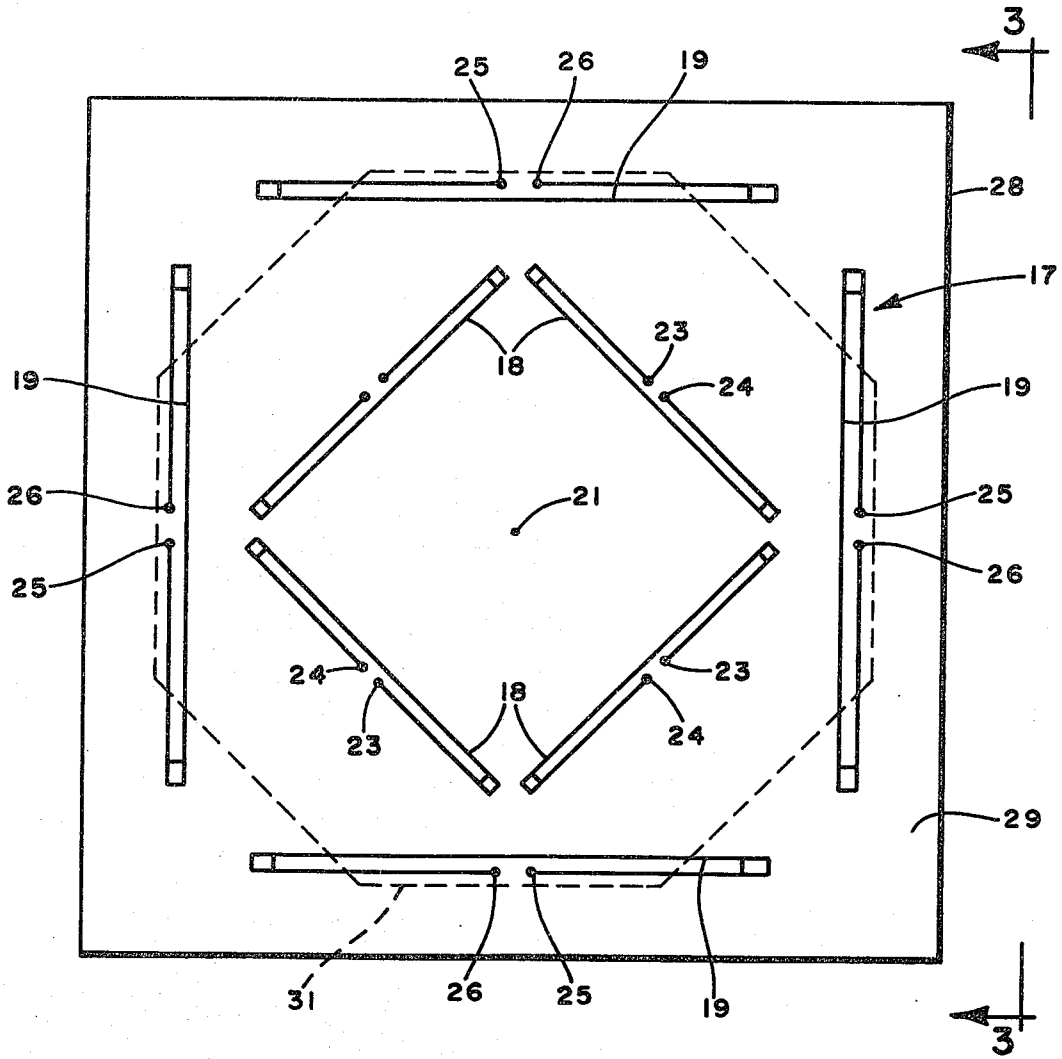
FIG. 2 is a plan partially schematic view of an antenna embodying this invention.

Feed device 13 embodying this invention is shown in FIGS. 2 and 3 and comprises an antenna array having two sets or rings 16 and 17 of dipole elements 18 and 19, respectively, preferably folded dipoles as shown, disposed concentrically about the center point 21 of the array. Each of the dipole rings 16 and 17 has four circumferentially spaced dipoles arranged in opposed parallel pairs in a generally square configuration. Each dipole 18 has feed terminals 23 and 24 and each dipole 19 has feed terminals 25 and 26.

Dipoles 18 and 19 are supported in a common plane by a nonconductive member 28 such as a block of dielectric foam. Member 28 has a plane surface 29 and dipoles 18 and 19 are mounted adjacent to surface 29, preferably in shallow recesses in member 28 so as to be flush with surface 29, all of dipoles 18 and 19 being coplanar. Member 28 is secured to an octagonally shaped block 31 of suitable material such as fiberglas for mounting purposes.

Inner dipole ring 16 is angularly oriented relative to outer ring 17 such that each dipole 18 extends in a direction that is transverse to each dipole 19. More specifically and preferably the axes of dipoles 18 and 19 intersect at an angle of 45°.

Figure 4:
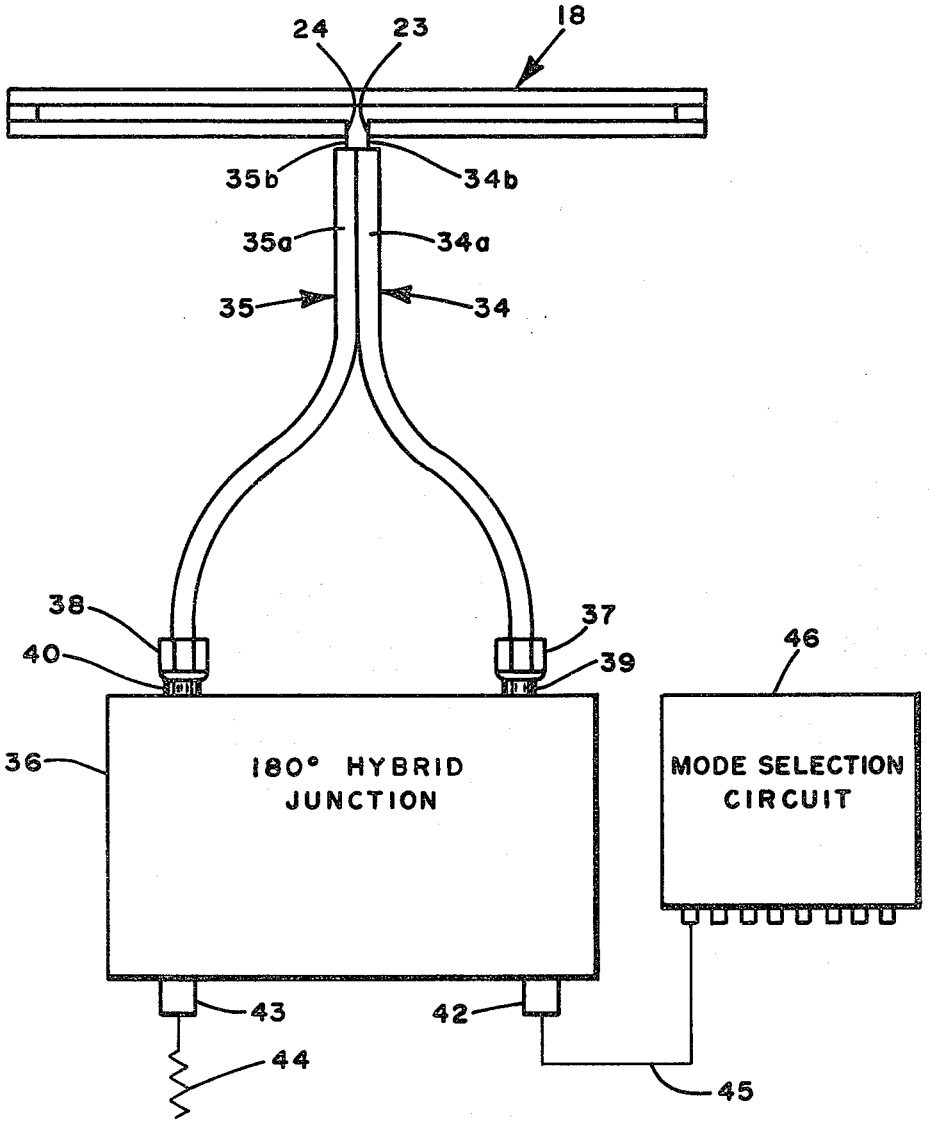
FIG. 4 is a partially schematic enlarged elevation of one of the dipole elements of the array showing its connection by feed components to mode control circuitry.

Each dipole of the array is fed by a pair of phase matched coaxial cables 34 and 35, see FIG. 4, having outer conductors 34*a* and 35*a* and inner conductors 34*b* and 35*b*, respectively. Cables 34 and 35 are connected between the dipole and a 180° hybrid junction 36. The length and impedance of the cables are selected so that the cables behave as a quarterwave transformer. The 180° hybrid junction introduces a 180° phase shift between cables 34 and 35. Cable inner conductors 34*b* and 35*b* are connected to dipole feed terminals 23 and 24, respectively, and cable outer conductors 34a and 35a are connected together and to ground through hybrid junction 36. Cables 34 and 35 have connectors 37 and 38, respectively, at their lower ends for connection to output ports 39 and 40, respectively, of hybrid junction 36. Each dipole preferably is made of conductive tubing configured as shown in the well-known folded shape for broadband operation. Each dipole array is capable of operating over a 50% bandwidth.

The opposite or input side of hybrid junction 36 has a difference port 42 and a sum port 43 terminated with a resistive load 44. The hybrid junction is fed from difference port 42 to provide a signal at output ports 39 and 40 that are phased 180° apart. Port 42 is connected by line 45 to one terminal of a mode selection circuit 46 which has additional terminals adapted to be connected to the difference ports, respectively, of hybrid junctions associated with the other dipole elements of the antenna system. Circuit 46 enables connection of the dipoles in various combinations to produce desired radiation pattern polarizations. For example, the dipoles may be connected to produce either sense of circular polarization or the two orthogonal linear polarizations.

Figure 5:
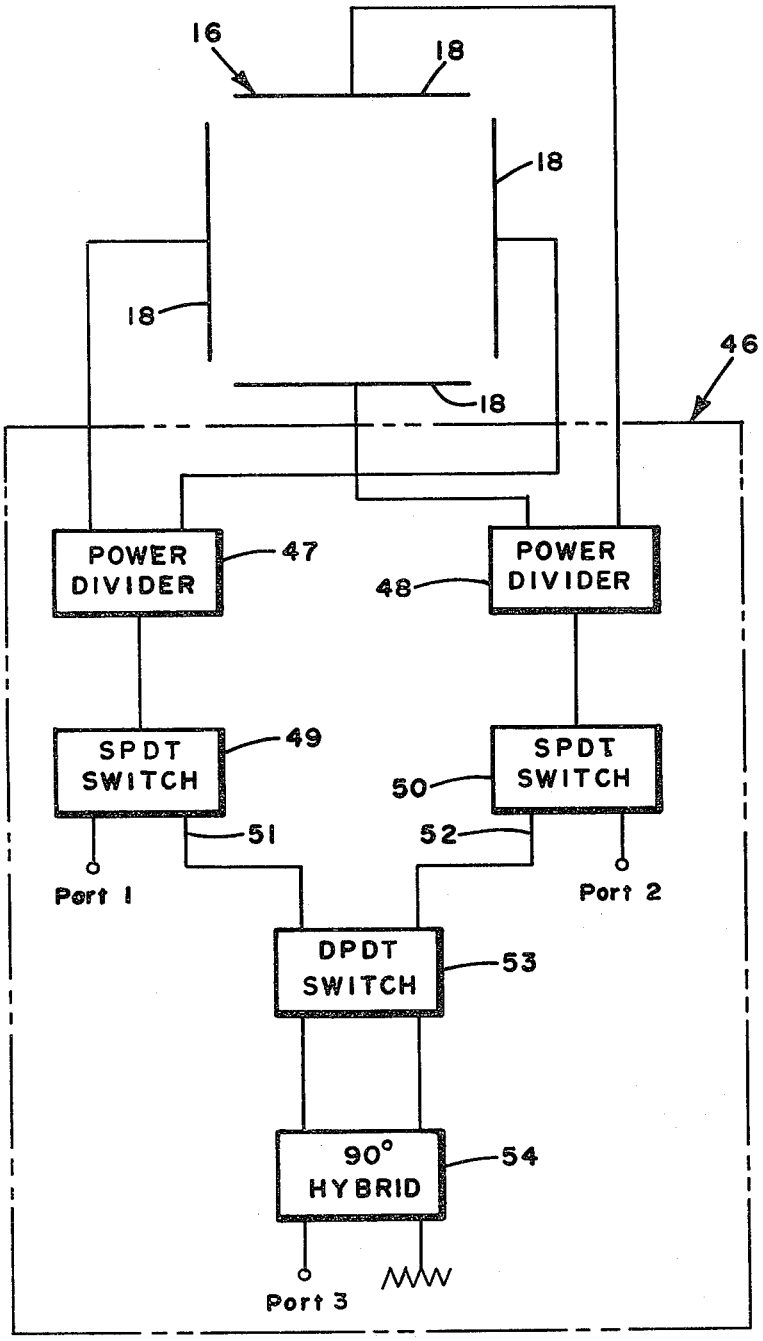
FIG. 5 is a schematic diagram of circuit useful in selecting antenna operating modes.

Circuit 46 is well-known in the antenna art and may, by way of example, comprise power dividers 47 and 48, see FIG. 5, connected to the outputs of opposite pairs, respectively, of dipoles 18, and single-pole double-throw switches 49 and 50 connected to the outputs, respectively, of power dividers 47 and 48. Switches 49 and 50 have outputs 51 and 52, respectively, connected to a double-pole double-throw switch 53 having outputs connected to a 90° hybrid coupler 54. Switches 49 and 50 also have outputs connected to ports 1 and 2, respectively, and coupler 54 has an output connected to port 3, the other output therefrom being terminated by a resistive load.

In operation, with switches 49 and 50 making connection to ports 1 and 2, respectively, a vertically polarized output exists at port 1 and a horizontally polarized output exists at port 2. If switches 49 and 50 are operated so that their outputs are connected to switch 53, circular polarization can be generated by throwing switch 53 so that its outputs are connected to coupler 54, the circularly polarized signal existing at port 3. The sense of polarization, either right or left hand, is selected by setting of switch 53.

Figure 6:
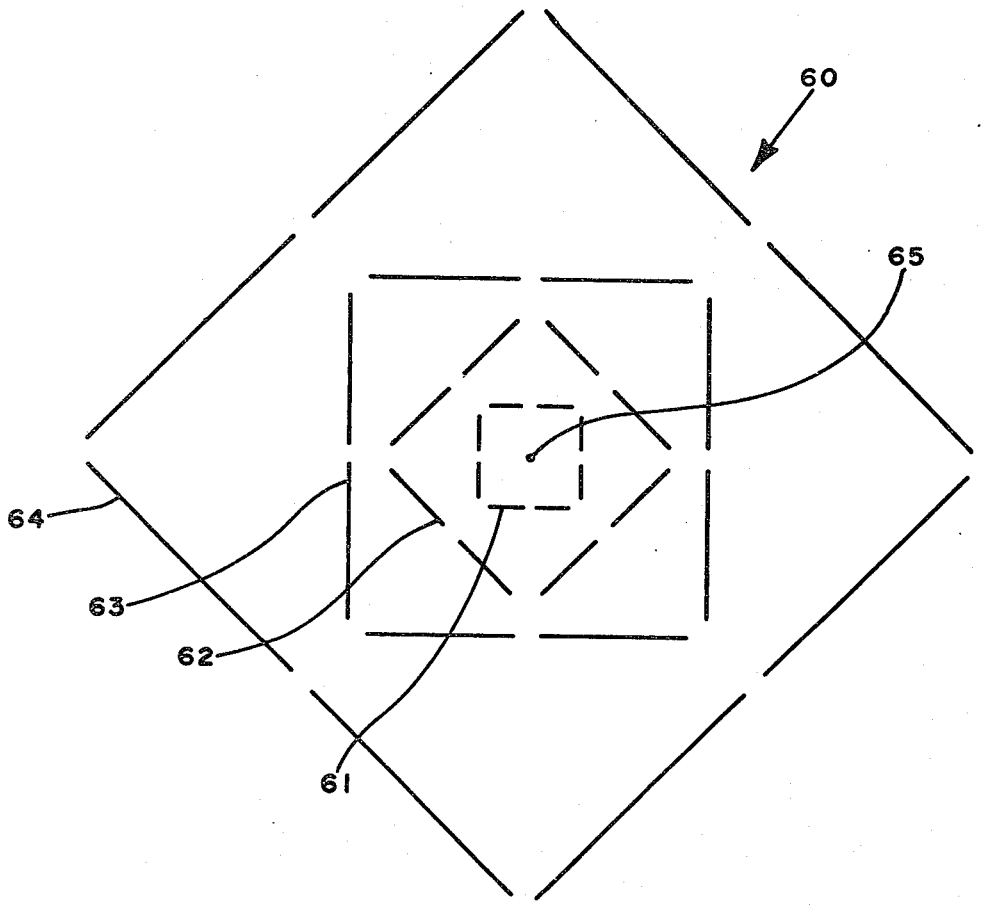
FIG. 6 is a schematic plan view of a modified form of the invention having four sets or rings of dipole elements.

The foregoing description of a preferred embodiment of the invention having two rings of dipole elements is given by way of example and not by way of limitation. The invention may be practiced with more than two rings of elements as shown in FIG. 6 which illustrates an array 60 having four concentric rings 61, 62, 63 and 64 of dipole elements. The lowest operating frequency achievable with array is limited only by the largest size of ring dipole array that can be tolerated. The highest operating frequency is limited only by the mechanical tolerances which can be maintained in manufacturing the smallest size of ring dipole array. As with the two ring array, the phase center of each ring dipole array of the four ring configuration is coincident at a single point 65.

The utility of the multi-ring dipole array embodying this invention is not limited to use as a feed for a parabolic reflector. The array may be cavity-backed, that is, mounted over a reflective cavity to operate as an independent moderate-gain antenna with selectable polarization as desired.

What is claimed is:

1. An antenna array comprising a plurality of concentric sets of coplanar dipole elements, each of said sets having opposed pairs of said elements with the elements of each set pair being equally spaced and parallel to each other and perpendicular to the elements of the other pair of the same set, the lengths of and spacing between parallel elements in one set being less than the lengths of and spacing between parallel elements in the adjacent set, each element in said one set extending in a direction transversely of the elements in the adjacent set, means to support said elements in a common plane, and means to feed said elements.

2. The array according to claim 1 in which said support means comprises a dielectric member having a plane face, said elements being mounted adjacent to said face.

3. The array according to claim 1 in which each of said elements is a folded dipole.

4. The array according to claim 1 in which the lengths of said elements of each set correspond to an operating frequency equivalent to at least 50 percent bandwidth with the frequency ranges of adjacent sets overlapping.

5. The array according to claim 1 in which each of said elements has two feed points, said last named means comprising a pair of coaxial cables for each element adapted to carry electrical signals thereto and therefrom, each of said cables having an inner conductor and an outer conductor, the inner conductors of each pair of cables being connected to the feed points, respectively, of an element, and means for producing an impedance transformation.

6. The array according to claim 5 in which said last named means comprises a hybrid junction connected to said pair of cables for producing a 180° electrical phase shift between signals on said cables, said hybrid junction having a sum port and a difference port, and a resistive load connected to said sum port.

7. An antenna array comprising first and second concentric rings, each of said rings having four identical dipole elements spaced from each other and arranged in a square configuration, said first ring having dimensions greater than the dimensions of said second ring and oriented relative thereto so that a diagonal of the first ring intersects the diagonal of the second ring at an angle of 45°, means to feed said dipole elements, and means to support said first and second rings of elements in a common plane.

8. The array according to claim 3 in which said dipole elements are folded dipoles.

* * * * *